United States Patent [19]

Dahlgren et al.

[11] 4,127,067

[45] Nov. 28, 1978

[54] METHOD FOR INKING PRINTING PLATES

[76] Inventors: Harold P. Dahlgren, 726 Regal Row, Dallas, Tex. 75247; Harvey W. Dahlgren, P. O. Box 8234, Mobile, Ala. 36608

[21] Appl. No.: 698,765

[22] Filed: Jun. 22, 1976

Related U.S. Application Data

[60] Continuation of Ser. No. 442,764, Feb. 15, 1974, abandoned, which is a division of Ser. No. 251,740, May 9, 1972, abandoned.

[51] Int. Cl.[2] ..... B41F 7/26; B41F 7/36; B41F 31/06

[52] U.S. Cl. ..... 101/426; 101/148; 101/350

[58] Field of Search ..... 101/148, 349, 350, 351, 101/352, 363, 364, 206, 207, 208–210

[56] References Cited

U.S. PATENT DOCUMENTS

| | | | |
|---|---|---|---|
| 2,042,943 | 6/1936 | Hoyce | 101/365 |
| 2,366,375 | 1/1945 | Worthington | 101/364 |
| 2,631,643 | 3/1953 | Schueler | 101/364 |
| 2,902,926 | 9/1959 | Ritzerfeld et al. | 101/148 |
| 2,972,298 | 2/1961 | DeMarchi | 101/350 |
| 3,026,795 | 3/1962 | Dietrich | 101/148 |
| 3,141,408 | 7/1964 | Bernardi et al. | 101/350 X |
| 3,259,062 | 7/1966 | Dahlgren | 101/148 X |
| 3,283,712 | 11/1966 | Chambon | 101/350 |
| 3,285,169 | 11/1966 | Hartwig | 101/350 |
| 3,343,484 | 9/1967 | Dahlgren | 101/350 X |
| 3,404,625 | 10/1968 | White | 101/148 |
| 3,433,155 | 3/1969 | Norton | 101/148 |
| 3,504,626 | 4/1970 | Worthington | 101/350 X |
| 3,508,489 | 4/1970 | Norton | 101/148 |
| 3,514,312 | 5/1970 | Gardiner | 117/75 X |
| 3,587,460 | 6/1971 | Chambon | 101/148 |
| 3,688,694 | 9/1972 | Preuss | 101/350 |

*Primary Examiner*—J. Reed Fisher

*Attorney, Agent, or Firm*—Lowe, King, Price & Becker

[57] ABSTRACT

An inker comprising two rollers having surfaces in pressure indented relation, the contacting surfaces moving in opposite directions to meter ink. A surface of one of the rollers carries a film of ink to the printing plate and thereafter an excessive quantity of ink is applied as the surface moves away from the printing plate. The excessive quantity of ink is metered between the surfaces of the two rollers moving in opposite directions to form a fresh continuous uniform thickness for application to the printing plate.

7 Claims, 23 Drawing Figures

METHOD FOR INKING PRINTING PLATES

CROSS REFERENCE TO RELATED APPLICATIONS

This is a continuation of application Ser. No. 442,764, now abandoned, filed Feb. 15, 1974, which is a division of application Ser. No. 251,740, filed May 9, 1972, now abandoned.

BACKGROUND OF INVENTION

Devices for inking lithographic printing plates generally comprise a plurality of form rolls which contact a printing plate. Each of the form rolls is usually in rolling contact with one or more vibrator rollers to which ink is applied by a large number of rollers, generally twenty or more, arranged in pyramid fashion.

Inking systems currently in use generally have rollers in the ink train of varying diameters, some of which vibrate longitudinally in an effort to eliminate ghosting and to provide desired quantities of ink to the printing plate.

The quantity of ink supplied through a train of rollers to a printing plate is generally controlled by adjusting ink keys and controlling dwell time of ductor rollers to control the input of ink to the long train of rollers. Heretofore, on a press for printing sheets 38 inches wide about 60 individual inker adjustments had to be correlated. Changing a first adjustment required a change of a second which in turn required a third and usually readjustment of the first. The effect of such a change was not apparent on printed sheets for about 5 minutes and thus resulted in wasting excessive quantities of paper, sometimes 500 sheets or more, while the operator adjusted the ink train by trial and error.

Since ink is applied by form rollers only to image areas of the plate, form rollers have a memory because ink accumulates on areas of the form rollers which contact non-image areas of the plate. The operator is faced with the impossible task of adjusting the inker to feed ink to the areas of the form rolls corresponding to image areas while attempting to minimize accumulation on areas corresponding to non-image areas. As a result, part of the image areas are starved and undesirable accumulation results on other parts of the rollers.

SUMMARY OF INVENTION

The present invention relates to a method and apparatus for metering ink wherein the complex ink train and the large number of rollers associated therewith have been eliminated. The ink train has been replaced by an applicator roller, having an ink receptive surface in engagement with a printing plate, in combination with very simple metering apparatus for metering a fresh uniform film of ink onto the applicator roller for application to the printing plate.

Metering is accomplished by positioning rollers having ink receptive surfaces in pressure indented relation and then rotating the adjacent surfaces in opposite directions. The thickness of the ink film carried by the applicator roller to the printing plate is controlled by adjusting pressure between the rollers and by adjusting the relative speed of rotation of the rollers.

The surface of the applicator roller is offered more ink than it is capable of carrying, thereby destroying any image retained thereon to eliminate ghosting. The ink is then metered through the nip between rollers in pressure indented relation and an ink film of metered thickness is carried by the applicator roller to the plate. To assure uniform metering an ink film on the surface of the metering roller moving toward contact with the applicator roller is doctored to provide an endless uniform wiping surface of uniform consistency at the metering nip such that the thickness of the film metered between the rollers will be uniform, predictable, and controllable for a preselected relative surface speed and pressure relationship.

A primary object of the present invention is to provide a continuous duty inking system providing precision control of the thickness of the ink film delivered to the plate.

Another object of the invention is to provide an inking system having a minimum number of ink rollers rendering the system immediately responsive to control to eliminate the necessity of trial and error adjustment to establish and maintain desired quantities of ink for application to a printing plate.

Another object of the invention is to provide an inking system which is nonaccumulative eliminating variation of color as a result of irregular ink film thickness longitudinally of rollers.

A still further object of the invention is to provide an inking system wherein an excessive quantity of ink is applied to the surface of an applicator roller which is moving from engagement with the plate to completely eliminate ghosting.

A further object of the invention is to provide an inking system having rollers in pressure indented relation, contacting surfaces thereof moving in opposite directions to calender and meter a smooth ink film, and to eliminate film splitting at the metering nip and resultant lack of uniformity of film thickness.

A further object of the invention is to provide an inking system capable of applying fast drying inks thus eliminating the necessity for the use of ovens and spray powder to minimize air pollution which has heretofore accompanied printing operations.

A still further object of the invention is to provide an an inking system which is simple to operate, providing control by merely turning a dial, eliminating the necessity for highly skilled operators to adjust the ink balance.

A still further object of the invention is to provide an inking system of simple, but efficient construction requiring minimum maintenance thus allowing fast startups and easy cleanup.

A still further object of the invention is to provide an inking system adapted to extract lint from ink as the ink is metered onto an applicator roller.

Other and further objects of the invention will become apparent upon reference to the detailed description hereinafter following and the drawings annexed hereto.

DESCRIPTION OF DRAWING

Drawings of preferred embodiments of the invention are annexed hereto so that the invention may be better and more fully understood in which.

Numeral references are employed to designate like parts throughout the various figures of the drawing.

DESCRIPTION OF A PREFERRED EMBODIMENT

Figure 1:
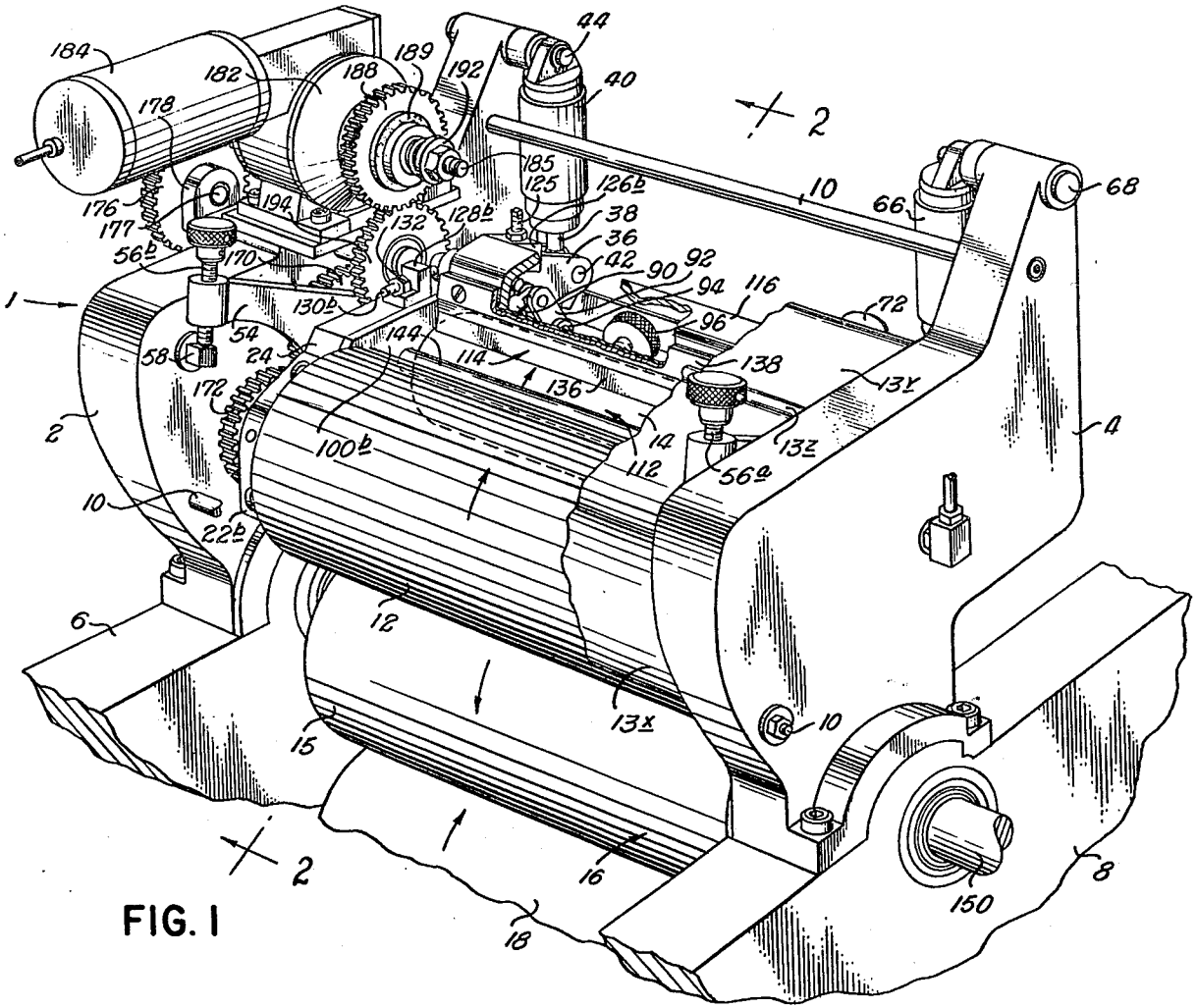
FIG. 1 is a perspective view of a preferred embodiment of the inking device.

Referring to FIG. 1 of the drawing, the numeral 1 generally designates an inker having a side frame 2 on the drive side and side frame 4 on the operator side secured to side frames 6 and 8 of a printing press. Side frames 2 and 4 are connected by suitable reinforcing means such as tie bars 10 forming a strong rigid structure to which applicator roller 12 and metering roller 14 are secured. Plate cylinder 16 and blanket cylinder 18 are rotatably disposed between the press side frames 6 and 8.

The applicator roller 12 has a rigid tubular metallic core 12*a* about which is disposed a smooth, resilient covering such as plastic or rubber composition which is preferably non-absorbent. A preferred roller construction and method of making same is described in U.S. Pat. No. 3,514,312 to Peter Gardiner entitled "Process for Coating a Metal Surface".

The patent to Gardiner relates to formation of a bond between a resilient vinyl chloride plastisol (over 100 PHR of plasticizer) and a metal substrate to form a roller having a resilient working surface (12–50 Shore A durometer). The surface of the applicator roller 12 and the surface of the blanket on cylinder 18 preferably have substantially equal resilience, for example in a range of 40–90 Shore A Durometer.

Reference is made to the patent to Gardiner for details of construction of applicator roller 12. However, the roll preferably comprises a metallic core 12*a* having a clean roughened surface to which coating of adhesive is applied. The metal is heated to a temperature above the gel temperature of the plastisol and a first layer of plastisol is applied to the surface of the adhesive to allow formation of a layer of such plastisol of substantial thickness. A second layer of plastisol having a higher proportion of plastisizer therein than the first layer is applied over the first layer and the layers of plastisol and adhesive are completely cured to form an integral covering 12*b* securely bonded to the surface of rigid core 12*a*. The resilience of the surface 12*b* is controllable by varying the proportions of plastisol and plastisizer.

The resilient surface 12*b* of applicator roller 12 is preferably very smooth and impervious and should have a high affinity for ink. This allows metering of a very thin film while providing optimum control.

Metering roll 14 preferably has a hard exterior surface which is highly polished and treated to render same receptive to the particular fluid being metered thereby. For precision control the fluid being metered should wet the surface of the applicator roller 12 and the metering roller 14. However, electro-deposited chromium surfaces have nonwetting characteristics.

Preferably the surface of roller 14 is chrome plated providing a long-wearing corrosion resistant surface, and is polished and treated after chrome plating to provide a surface which is smooth so that no irregularities or coarse surface areas exist thereon which would cause a thin film to break resulting in accumulation of ink in an irregular pattern over the surface of the roller.

Metering roll 14 is preferably constructed in accordance with the teaching of U.S. Pat. No. 3,168,037 to Harold P. Dahlgren entitled "Means for Dampening Lithographic Offset Printing Plates" which describes a chrome plated roller the surface of which is polished and then bathed with a solution of one part hydrochloric or sulfuric acid, one part gum arabic water solution, and one part water to chemically etch the surface. The acid dissolves and removes chromium oxide from the surface, and the gum arabic coats the surface of the chrome to prevent further oxidation. The chrome surface thus treated is hydrophilic, having a high affinity for moisture and is wetted by aqueous liquid; and, so long as moisture is present to form a film separating the surface from ink, the surface is ink rejecting.

In the absence of moisture the highly polished chrome surface has an affinity for ink, such that the ink may be spread in a smooth uniform layer over the surface thereof, and the ink will adhere tenaciously thereto.

It should be noted that by preparing the surface of metering roller 14 as described above while omitting the gum arabic or reducing the quantity of gum arabic in the solution in which the polished surface is bathed, the formation of oxide on the surface of roller 14 may be controlled to cause the surface of the roller to have uniform affinity for oil base ink over the surface thereof.

Metering roller 14 may be etched electrolytically, in lieu of chemically, by making the surface the anode in an electrolytic solution and preferentially dissolving portions of the surface to form microscopic indentations in the surface. The indentations do not extend to the base metal core of roller 14. Thus the etched surface is corrosion resistant and the microscopic indentations formed therein eliminate the nonwetting characteristics thereof.

After the surface of the metering roller 14 has been etched, it is polished or buffed with crocus cloth to provide a smooth uniform uninterrupted surface with microscopic pits and indentations therein. As hereinbefore discussed, necessity of treatment of the etched surface with gum arabic is dependent upon the nature of the fluid to be metered.

It should be appreciated that roller 14 may be constructed of other materials such as stainless steel, aluminum, or other noncorrosive material without departing from the basic concept of our invention.

Figure 3:
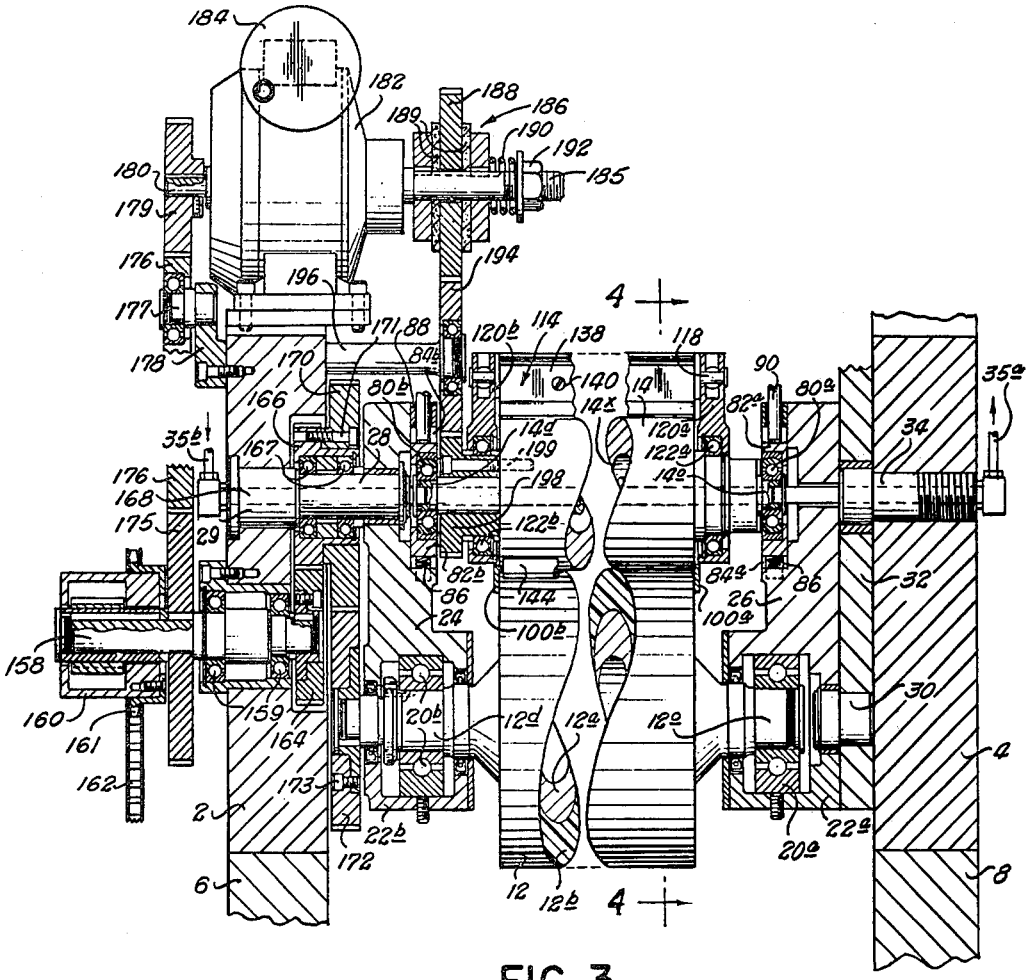
FIG. 3 is a cross-sectional view taken substantially along line 3—3 of FIG. 2.

As best illustrated in FIG. 3 means is provided to control the temperature of the surface of roller 14 to maintain the temperature of ink within workable limits.

The temperature of the ink should be in a range between 65° F. and 95° F. If the temperature becomes excessively high, volatile components of the ink will evaporate. As the temperature is reduced the viscocity of the ink increases.

While other means may be employed for controlling the temperature of the ink, cooling water is circulated through lines 35*a* and 35*b* to the chamber 14*x* inside metering roller 14.

To further limit evaporation of volatile inks, a cover, (FIG. 4) comprising segments 13*x* and 13*y* connected by a hinge 13*z*, is positioned over rollers 12 and 14 to form an enclosed atmosphere of limited volume which will become saturated with vapor thus limiting further evaporation.

As best illustrated in FIG. 3, applicator roller 12 has opposite ends 12*o* and 12*d* rotatably journaled in eccentric bearings 20*a* and 20*b* mounted in split bearing blocks 22*a* and 22*b* on hangers 24 and 26, respectively.

Hanger 24, on the drive side of the inker, is pivotally supported on stub shaft 28 having an end 29 secured in an opening formed in the side frame 2 on the drive side of the inker 1.

Hanger 26 is pivotally secured by a stub shaft 30 and arm 32 which is pivotally secured by a stub shaft 34, to the side frame 4 on the operator side of the inker 1.

Stub shaft 28, secured to the side frame 2 on the device side, and stub shaft 34, secured to the side frame 4 on the drive side, are axially aligned.

Hanger 24 on the drive side of the inker has a rearwardly extending projection 36 (FIG. 2) formed thereon to which piston actuated rod 38 of throw-off cylinder 40 is pivotally connected by suitable means, such as pin 42. Throw-off cylinder 40 is connected by suitable means, such as pin 44, to the operator-side side frame 2 of the inker 1.

Hanger 24 has an abutment 46 formed thereon positioned to engage suitable motion limiting means, such as off-stop 48. The motion limiting means comprises a threaded member 50 threadedly secured in a block 52 extending inwardly from a rear portion of inker side frame 2.

Hanger 24 has a forwardly extending projection 54 formed thereon which threadedly receives a threaded member 56*b* positioned to engage motion limiting means, such as on-stop 58 extending inwardly from inker side frame 2.

Figure 4:
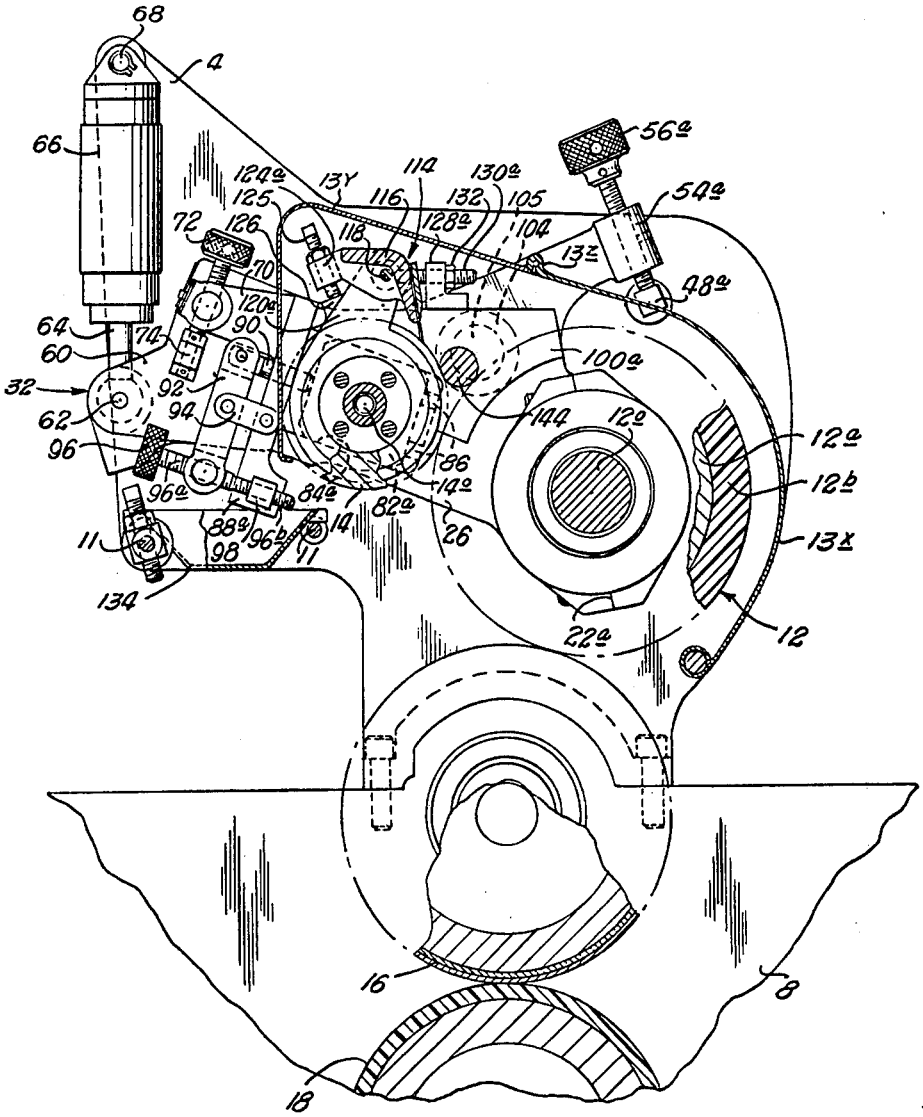
FIG. 4 is a cross-sectional view taken substantially along line 4—4 of FIG. 3.

As best illustrated in FIG. 4, the arm 32 has a rearwardly extending projection 60 which is pivotally secured by a pin 62 to a piston actuated rod 64 of throw-off cylinder 66. Throw-off cylinder 66 is pivotally connected by a pin 68 to the operator-side side frame 4 of the inker 1.

Hanger 26, adjacent to the operator-side frame 4, has a rearwardly extending projection 70 formed thereon through which skew adjustment screw 72 is threadedly secured. The lower end of skew adjustment screw 72 is rotatably secured in an anchor member 74 which is rigidly connected to arm 32. Rotation of screw 72 causes hanger 26 to pivot about shaft 30, which is axially aligned with applicator roller 12 to move an end of roller 14 circumferentially about the axis of roller 12.

Arm 32 has a forwardly extending projection 54*a* threadedly receiving threaded member 56*a* which may be adjusted relative to on-stop 48*a* to control pressure between contacting surfaces of applicator roller 12 and the plate 15 on plate cylinder 16.

Figure 2:
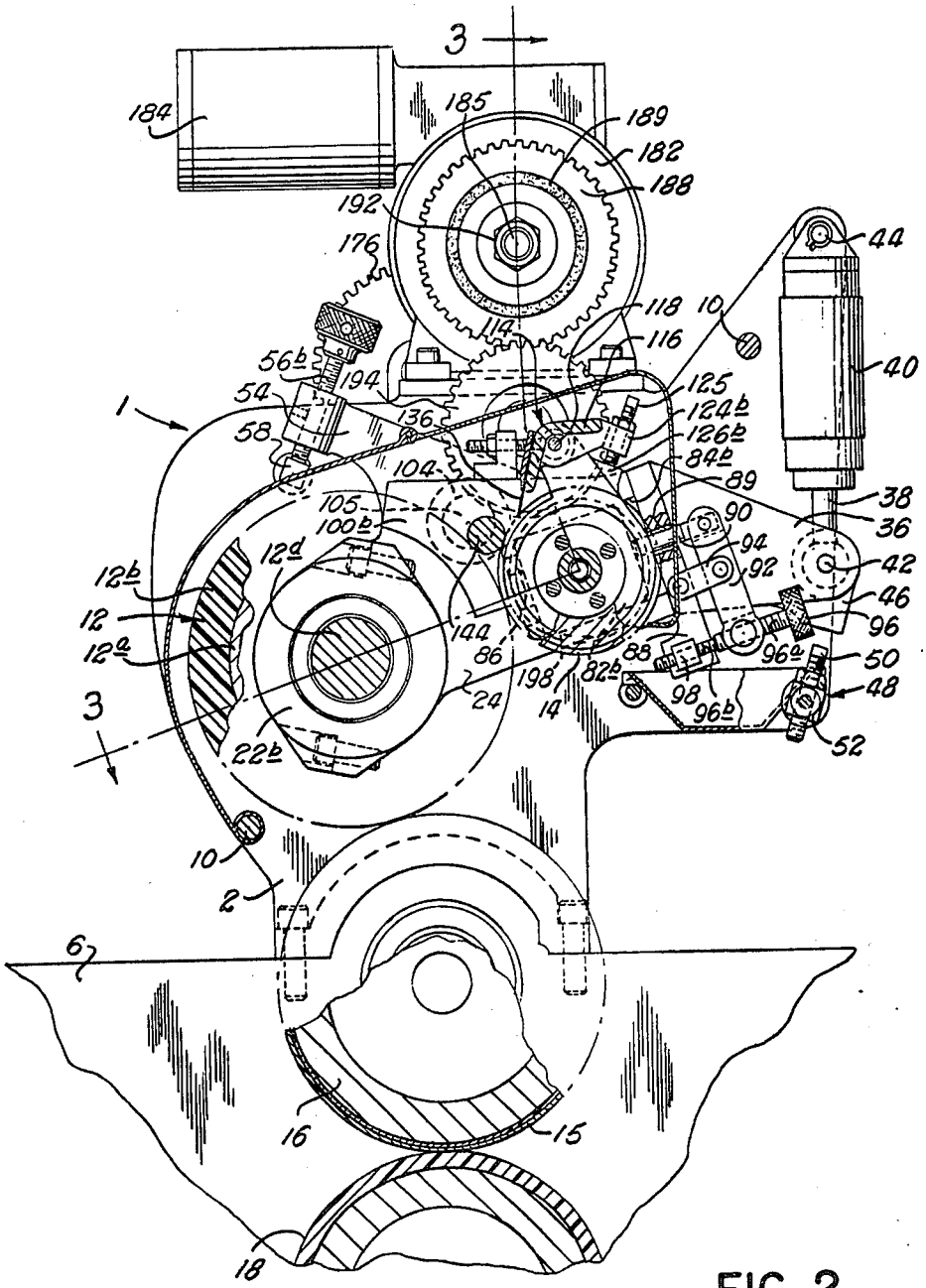
FIG. 2 is a cross-sectional view taken substantially along line 2—2 of FIG. 1.

As best illustrated in FIGS. 2, 3, and 4 opposite ends 14*o L* and *14d* of metering roller 14 are rotatably journaled in self aligning bearings 80*a* and 80*b* in blocks 82*a* and 82*b* which are movably disposed in slots 84*a* and 84*b* formed in hangers 26 and 24, respectively.

Springs 86 urge blocks 82*a* and 82*b* longitudinally through slots 84*a* and 84*b*, respectively.

Hanger 24 has a support plate 88 welded or otherwise secured thereto and has a bushing 89 secured in an aperture extending therethrough through which a pin 90 is slidably disposed. The outer end of pin 90 is pivotally connected to one end of a link 92 which is pivotally connected intermediate opposite ends thereof to a fulcrum link 94 secured to support plate 88. The other end of link 92 is threadedly secured to a first threaded portion 96*a* of adjustment screw 96. Adjustment screw 96 has a second threaded portion 96*b* which threadedly engages lug 98 secured to support plate 88. Portions 96*a* and 96*b* of the adjustment screw 96 have threads with different leads such that movement of the screw 96 in combination with the mechanical advantage provided by links 92 and 94 provide a means to precisely control pressure between contacting surfaces of metering roller 14 and applicator roller 12.

As best illustrated in FIG. 4, hanger 26, adjacent to the operator-side side frame 4, has a support plate 88*a* secured adjacent the outer end thereof to which a pin 90, links 92 and 94 and adjustment screw 96 are connected.

Figure 6:
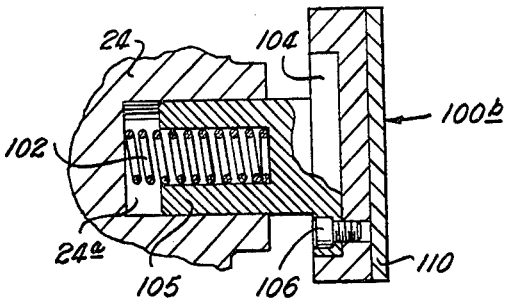
FIG. 6 is an enlarged fragmentary cross-sectional view illustrating details of construction of the end dam.

Referring to FIGS. 1, 2, and 6, end dams 100*a* and 100*b* are urged into pressure relation with ends of applicator roll 12 and metering roll 14 to form a reservoir 112 therebetween, the sides of the reservoir being defined by surfaces of applicator roller 12 and metering roller 14. The reservoir 112 comprises a means for applying an abundant supply of ink to the surface of applicator roll 12 as the surface moves away from engagement with the surface of plate 15 on plate cylinder 16.

As best illustrated in FIG. 6, hangers 24 and 26 have passages 24*a* and 26*a*, respectively, formed therein. Each of said passages 24*a* and 26*a* has resilient means, such as a spring 102, disposed therein for urging end dam pressure pads 104, having guide pins 105 slidably disposed in the passages, outwardly. Pressure pads 104 are disengagably secured by suitable means, such as set screw 106, to a bearing plate 108 which is bonded or otherwise secured to a facing member 110 constructed of Teflon (tetrafloroethylene), PVC (Polyvinyl chloride) or other suitable material. It should be appreciated that when face plate 110 of end dam 100 becomes worn the face plate may be easily changed by removing set screw 106, disconnecting plate 108 and attaching a new plate thereto.

As viewed in FIG. IV, metering roller 14 and applicator roller 12 each rotate in a counter-clockwise direction such that the contacting surfaces of the respective rollers move in opposite directions. Accordingly the surface of applicator roller 12 which is in contact with the surface of metering roller 14 is moving downwardly. The surface of metering roller 14 contacting the surface of applicator roller 12 is moving upwardly.

Means is provided for cleaning all of the ink from the surface of metering roller 14 or for forming a film of uniform thickness on the surface of the metering roller 14, as the surface moves away from the nip N and out of the ink reservoir. As best illustrated in FIGS. 1–4, 17 the means for removing all of the ink or a portion thereof from the surface of metering roller 14 comprises a doctor blade assembly 114 positioned to scrape ink from the surface while directing the ink removed back into the reservoir 112.

The doctor blade assembly 114 comprises a rigid blade holder 116 extending along the entire length of metering roller 14 and having opposite ends rotatably secured by pins 118 to arms 120*a* and 120*b* rotatably supported by bearings 122*a* and 122*b* adjacent opposite ends of metering roller 14.

Blade holder 116 has lugs 124*a* and 124*b* secured to opposite ends thereof to threadedly receive screws 125 having lower ends in engagement with abutment members 126*a* and 126*b* on arms 120*a* and 120*b*, respectively.

As best illustrated in FIGS. 1 and 4, stop members 128*a* and 128*b* are secured to hangers 26 and 24, respectively and have apertures formed therein through which bolts 130*a* and 130*b* extend. When nuts 132 are removed from bolts 130, arms 120*a* and 120*b* are free to rotate about the ends of metering roller 14 allowing the doctor blade assembly 114 to be pivoted rearwardly to a position adjacent pan 134 to clean the ink reservoir as will be hereinafter more fully explained. It should be appreciated that other means, such as a set screw, may be employed to disconnectably secure arms 120*a* and 120*b* relative to the hangers 24 and 26.

The pan 134 extends longitudinally between side frames 2 and 4 and is supported by suitable means such as tie bars 11 extending therebetween.

Doctor blade assembly 114 has a thin elongated flexible doctor blade 136 secured thereto by a blade clamp 138 secured to blade holder 116 by suitable means such as screws 140. The preferred embodiment of blade 136 illustrated is constructed of spring steel and has a thickness of approximately sixty thousandths of an inch. The blade 136 may be constructed of other materials such as brass or bronze. However, blade 136 is preferably constructed of material having a molecular structure different from that of metering roller 14 because the film 14*t* of ink, during starting and stopping periods, may become broken allowing surfaces of blade 136 and roller 14 to come into contact. Employment of unlike material minimizes wear and scoring of the surfaces and provides a low coefficient of friction.

The blade 136 is positioned between flexible plates 137 such that flexibility of the blade varies along the width thereof similar to a leaf spring. This construction provides a flexible edge 142 urged into engagement with the surface of roller 14 while providing a stiff upper edge which is securely attached to the blade holder 116.

Figures 17, 18:
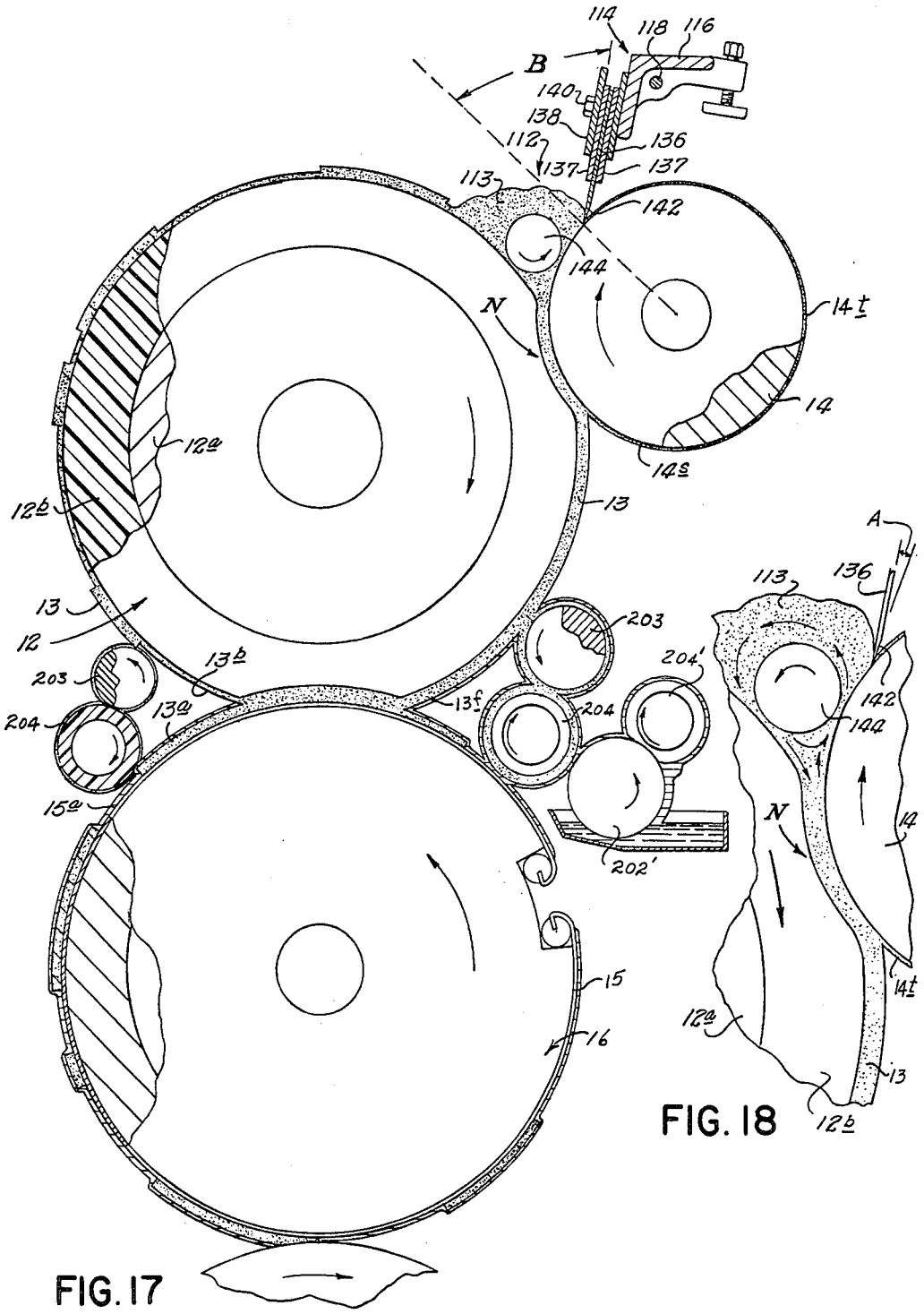
FIGS. 17 and 18 are enlarged views to more clearly illustrate the metering principle.

As best illustrated in FIG. 18, the blade 136 has a sharp lower edge 142 which is ground to provide a lip angle A of approximately 10°. It should also be noted that blade 136 is positioned such that the back rake angle B, the angle between the face of the blade 136 and a plane extending radially through the center of metering roller 14, measured in a clockwise direction is less than 90°. Hydraulic pressure of the ink urges the edge 142 of the blade 136 toward the surface of roller 14 such that an increase in hydraulic pressure increases the cleaning action of the blade.

It should be appreciated that blade 136 is oriented such that the sharp lower edge 142 thereof functions in a manner similar to that of a razor to sever ink from the hard smooth surface of metering roller 14 such that the surface 14*s* of metering roller 14 which is moving toward the metering nip N is substantially free of ink, the film 14*t* being of controlled uniform thickness. The function of doctor blade 136 is to provide uniform surface characteristics to the surface 14*s* which moves to the nip N such that hydraulic forces in the metering nip formed by the pressure indented surfaces of the metering and applicator rollers will be predictable. This allows precision control of the thickness of the film of ink 13 remaining on the surface of the applicator 12 as the surface of the applicator roller moves away from the metering nip N by control of pressure between surfaces of the metering and applicator rollers and the relative surface speeds thereof.

As best illustrated in FIGS. 1, 3, and 18, a roller or bar 144 extends longitudinally of the ink reservoir 112 and is positioned such that ink 113 in reservoir 112 will cause the bar to rotate in a counter-clockwise direction, as viewed in FIG. XVIII, thus transferring ink away from the surface of metering roller 14 toward the surface of applicator roller 12 to assure that an excess of ink is always applied to the surface of roller 12 which is approaching the metering nip N. The nip roller bar 144 also agitates the ink to remove bubbles of air therefrom.

Figure 14:
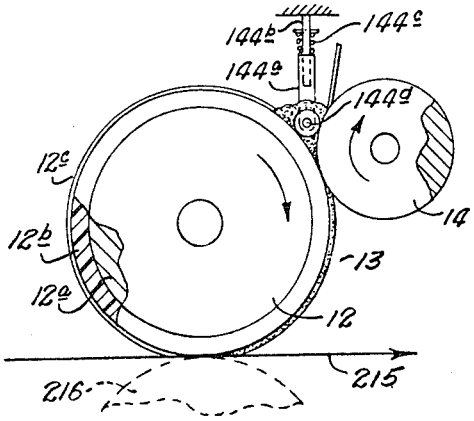
FIGS. 14 and 15 are fragmentary diagramatic views illustrating use of the first embodiment of the inker mechanism for applying moisture or coating to liquid receptive material.

In the particular embodiment of the invention illustrated in FIGS. 1–5 of the drawing, nip roll bar 144 is maintained in position by gravity and is rotated by attraction of ink to the surface thereof. The ends of nip roll bar 144 are free of connections to other structural members of the inker with the exception of sliding contact along end dams 100. However, depending upon the weight of nip roll bar 144, the viscosity of the ink 113, the speed of rotation of rollers 12 and 14, and the surface characteristics of the various members, if it is deemed expedient to do so, nip roll bar 144 may be secured to suitable mounting means for urging same toward the surface of either of the rollers and nip roll bar 144 may be positively driven. Such mounting means, as illustrated in FIG. 14, comprises telescoping tubular members 144*a* and 144*b* urged apart by a spring 144*c*. Nip roll bar 144 is rotatably journaled in bearings 144*d*.

Suitable means is provided for transmitting power to applicator roller 12 and metering roller 14. Such power transmitting means may comprise an independent drive means such as an elective motor, or power transmitting elements connected to the press drive means.

In the particular embodiment of the invention illustrated in the drawing, the plate and blanket cylinders 16 and 18 are driven by a motor (not shown) on the press.

Figure 5:
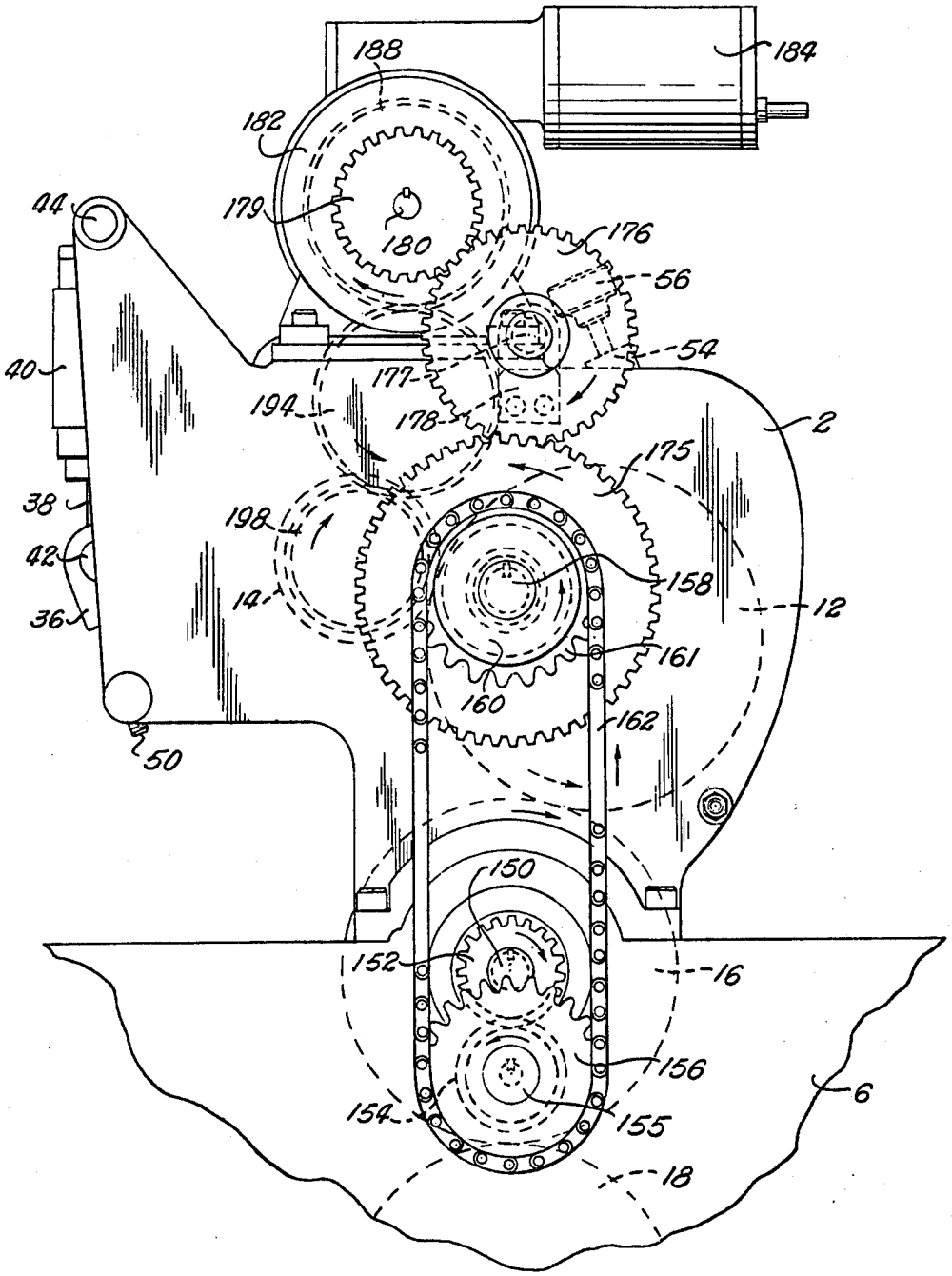
FIG. 5 is an elevational view of drive side of the inker.

As is best illustrated in FIGS. 3 and 5, the plate cylinder 16 is secured to a powered shaft 150 having a gear 152 secured thereto in meshing engagement with gear 154 secured to a shaft 155 having a sprocket 156 secured thereto.

A shaft 158 is rotatably journaled in bearings 159 in a passage extending through the drive-side side frame 2 of the inker 1. Shaft 158 has a unidirectional clutch 160 drivingly connected thereto which carries sprocket 161. A chain 162 extends about sprockets 156 and 161 for transmitting power to shaft 158. The clutch 160 is adapted to prevent rotation of shaft 158 in a reverse direction as will be hereafter more fully explained.

Shaft 158 has a gear 164 secured to the inner end thereof, said gear being disposed within a recess formed within the inner surface of the drive-side side frame 2 of the inker. Gear 164 is in meshing relation with a gear 166 rotatably mounted in bearings 167 on stub shaft 168. A gear 170 is secured by bolts 171 to the gear 166 causing the gears to rotate together. Gear 170 is in meshing relation with the gear 172 secured by a bolt 173 to the end **12*d* of applicator roll 12**.

It should be readily apparent that rotation of plate cylinder 16 imparts rotation through gears 152 and 154, shaft 155, sprocket 156, chain 162, sprocket 161, to clutch 160.

The clutch 160 imparts rotation through stub shaft 158 to gears 164, 166 and 170 to gear 172 which is connected for rotation of applicator roller 12.

Means is provided to rotate metering roller 14 at a variable speed relative to the speed of rotation of applicator roller 12. As best illustrated in FIG. V such means comprises a gear 175 secured to stub shaft 158 adjacent the outside of the drive-side side frame 2, said gear being in meshing relation with gear 176 rotatably journaled on stub shaft 177 secured by a bracket 178 to side frame 2. Gear 176 is in meshing relation with gear 179 secured to the input shaft 180 of speed reducer 182. Speed reducer 182 includes means 184 for controlling the speed ratio between input shaft 180 and output shaft 185.

The output shaft 185 (FIG. 3) of speed reducer 182 has a friction clutch 186 secured thereto.

In the particular embodiment of the invention illustrated in the drawing, friction clutch 186 comprises a gear 188 driven by friction members 189 urged into pressure engagement therewith by a spring 190. The force exerted by spring 190 is controllable by adjusting the position of nut 192 along the threaded output shaft 185 of speed reducer 182. The function of clutch 186 is to prevent damage to applicator roller 12 if ink is allowed to dry in the nip N between the applicator roller 12 and metering roller 14 bonding the surfaces together.

Gear 188 is disposed in meshing relation with gear 194 rotatably secured by stub shaft 196 to the sideframe 2 of the inker. Gear 194 is positioned in meshing relation with a gear 198 secured by suitable means, such as bolts 199, to metering roll 14.

From the foregoing it should be readily apparent that rotation of stub shaft 158 imparts rotation through gears 175, 176 and 179 for rotating the input shaft 180 of speed reducer 182. The output shaft 185 imparts rotation through clutch 186, gear 194, and gear 198 to metering roll 14.

It should be appreciated that adjacent surfaces of applicator roll 12 and metering roll 14 move in opposite directions as indicated by the arrows in FIG. I of the drawing.

Figure 23:
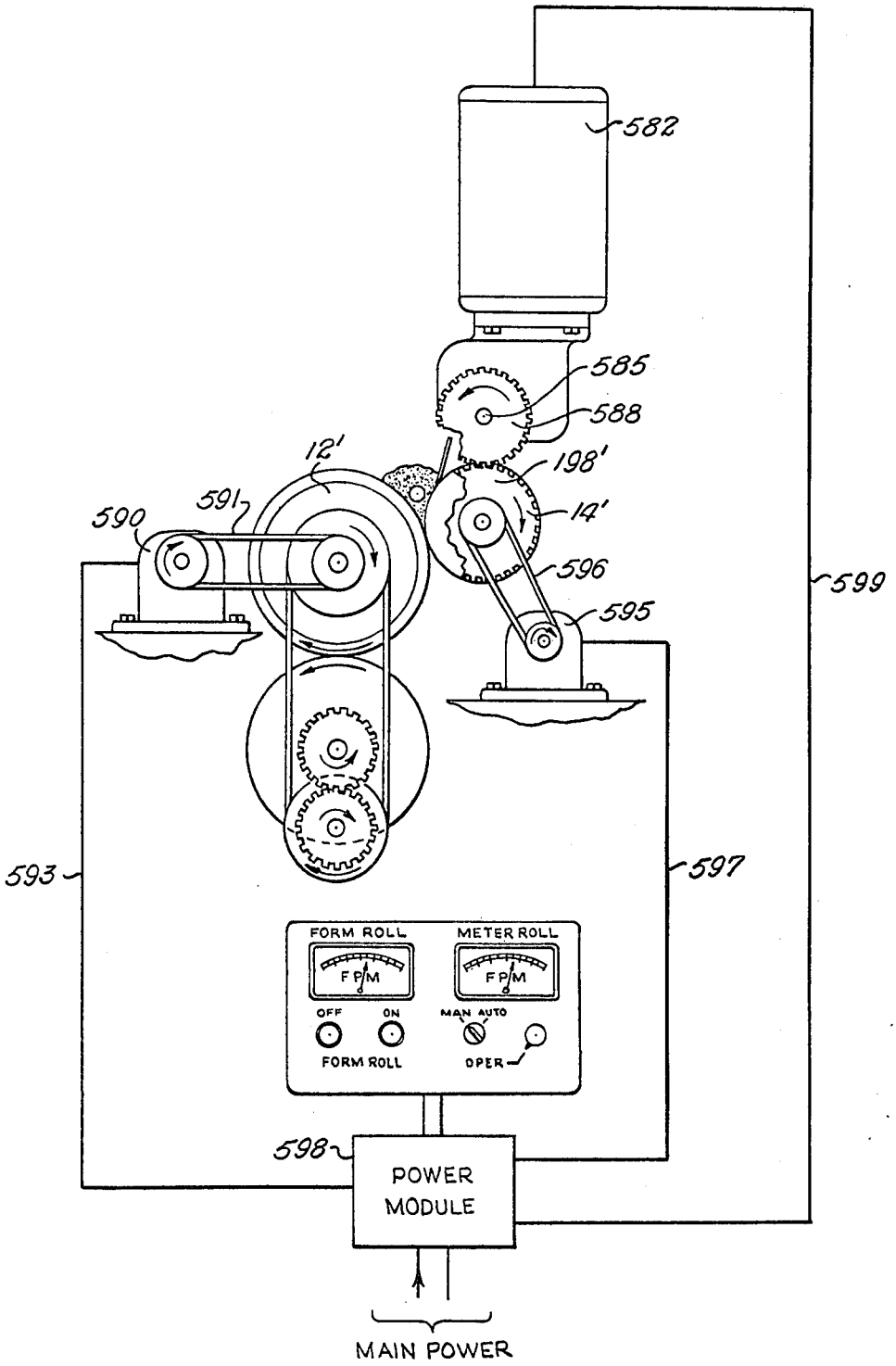
FIG. 23 is a diagramatic view of independent drive means for rotating the metering roller.

An independent drive means for the applicator roller 12 and metering roller 14 is illustrated in FIG. 23 of the drawing. The variable speed drive motor 582 has an output shaft 585 having a gear 588 secured thereto. Gear 588 is mounted in meshing relation with gear 198' secured to the end of metering roll 14'.

Applicator roller 12' is driven in the manner described above. A tachometer-generator 590 is driven through suitable means such as timing belt 591 by applicator roller 12'. A second tachometer-generator 595 is driven through a timing belt 596 by metering roll 14'. Generator devices 590 and 595 are connected through conductors 593 and 597, respectively, to a power module 598 which is connected to a suitable source of electricity (not shown). Power module 598 is connected through conductor 599 to the motor 482 which drives metering roller 14'.

Tachometer-generator devices 590 and 595 generate feedback signals which are delivered to the power module. The power module comprises potentiometer devices having variable resistors connected for controlling the speed ratio of applicator roller 12' and metering roll 14'.

When the applicator roller 12' is in the off position and the blade assembly 114 is rotated for wash-up motor 582 may be actuated allowing the inker to be cleaned while the press is stopped. The overriding clutch 160 (FIG. 3) allows the applicator roller 12' to be overdriven by the metering roll 14' rotated by motor 582 for wash-up although contacting surfaces of the rollers normally move in opposite directions under operating conditions.

When the inker is being operated, potentiometers in the power module 598 are adjusted to deliver signals through conductor 599 to cause motor 582 to rotate metering roller 14' at a pre-established speed ratio relative to applicator roller 12'. The speed ratio may be adjusted by changing the setting of the potentiometers. It should be appreciated that tachometer-generator 590 provides a voltage output, proportional to the speed of the press driven applicator roller 12', which in turn governs the speed of motor 582 driving metering roller 14'. Therefore, as the press speed is changed the applicator roller 12' is driven mechanically at the same speed. However, the speed of metering roller 14' is varied electrically by the output of tachometer-generator 590 to maintain a fixed relationship between surface speeds of the applicator roller 12' and metering roller 14'. Manual operation of metering roller speed potentiometer will override the tachometer-generator 590 and will change the ratio of the surface speed of the metering roller 14' relative to that of applicator roller 12'. An increase in the speed ratio of the metering roller 14' relative to that of the applicator roller 12' will meter less ink on the applicator roller surface and a decrease in the speed ratio will increase the thickness of the ink film on the applicator roller surface.

It should also be appreciated that the tachometer-generator 590 may be adapted to provide a non-linear output signal, resulting in a variation of the metering roller and applicator roller speed ratio as the press changes. This allows a non-linear decrease in the ratio of surface speeds of the metering roller 14' and applicator roller 12' as the press increases in speed and increases this ratio as the press speed is reduced.

Tachometer-generator 595 provides a signal for maintaining precise speed regulation of metering roller 14'. The feedback signal from generator 595 is representative of the actual speed of metering roller 14' which is coupled to the power module 598 and motor 482 forming a closed loop control capable of holding a pre-established speed ratio between applicator roller 12' and metering roller 14' regardless of load changes across motor 582.

The inker hereinbefore described may be used for applying ink to image areas of dry plates, those which do not require dampening fluid to cause non-image areas to reject ink, or on wet plates, those which employ dampening fluid on non-image areas.

FIGS. 7–13 are diagrammatic view of printing presses which employ a dampening device for applying dampening fluid to the printing plate 15 on the plate cylinder 16 of the press.

The dampening fluid is preferably of the type described in U.S. Pat. No. 3,259,062 to Harold P. Dahlgren, entitled "Process for Applying a Water Soluble Organic Dampening Fluid" which was a continuation-in-part and co-pending with application Ser. No.

26,035, now U.S. Pat. No. 3,168,037. The dampening fluid comprises a mixture of water mixed with a highly volatile commercial grade alcohol such as ethyl alcohol, methyl alcohol or isopropyl alcohol. The dampening system preferably has at least one hydrophillic roller disposed therein which is water liking and ink rejecting to prevent feedback of ink from applicator roller 12 to the pan 201 of dampening device 200.

Several arrangements of dampening devices are illustrated in FIGS. 7–13 of the drawing. It will be noted that in each dampener configuration the rollers are alternately hard surfaced and resilient surfaced allowing the rollers to be urged together in pressure indented relation for metering aqueous dampening fluid. Hard surfaced hydrophillic rollers 202 are preferably constructed according to the teachings of U.S. Pat. No. 3,168,037 to Harold P. Dahlgren entitled "Means for Dampening Lithographic Offset Printing Plates". Rollers 202 have hard continuous, uninterrupted, smoothly finished surfaces adapted to be wetted by the dampening fluid.

The resilient rollers 204 have smooth resilient surfaces adapted to be urged into pressure indented relation with the hard surfaced roller 202 allowing rotation of rollers 202 and 204 at different speeds, if it is deemed expedient to do so, for metering dampening fluid therebetween as described and claimed in the aforementioned patent.

Figure 10:
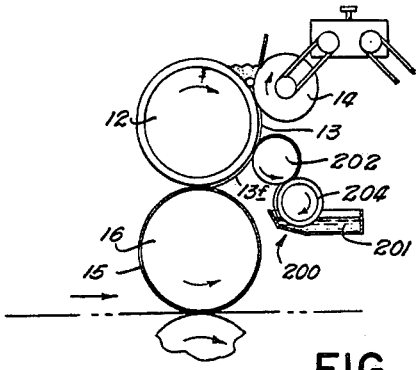

The preferred form of the dampening system in combination with the inker is illustrated in FIG. 10 wherein the printing plate 15 has ink receptive image areas and dampening fluid receptive non-image areas. Applicator roller 12 is in rotative contact with the surface of plate 15 and the ink metering roller 14 is in pressure indented relation with applicator roller 12, the contacting surfaces moving in opposite directions to meter a film of ink therebetween. Transfer roller 202 of the dampening system 200 has a hard smooth uninterrupted hydrophillic surface in pressure indented relation with applicator roller 12 and is positioned to deposit a thin film 13*f* of dampening fluid over the surface of the film of ink 13. Resilient roller 204 is positioned in pressure indented relation with transfer roller 202 such that by controlling pressure and relative surface speed of rollers 202 and 204 a film of dampening fluid of precisely controlled thickness may be applied to the surface of hydrophillic transfer roller 202.

FIG. 14 is a diagrammatic view of the modified form of the invention wherein the applicator roller 12, having a film of ink metered thereonto by its cooperative relationship with metering roller 14, applies the film of ink directly to a web of material 215. It should be noted that the surface of applicator roller 12 which engages the web 215 and the surface of web 215 move in opposite directions at the point of contact to develop a hydraulic pressure wedge urging ink into the liquid receptive material 215. It should further be noted that a backup roller 216 may be employed if it is deemed expedient to do so to increase pressure between ink film 13 and the web 215. The quantity of ink or other suitable coating material to be applied to web 215 is controllable by varying the pressure between applicator roller 12 and back-up roller 216, by varying the relative speeds of roller 12 and web 215, or by controlling the speed and pressure relationship between applicator roller 12 and metering roller 14 has hereinbefore been explained.

Figure 15:
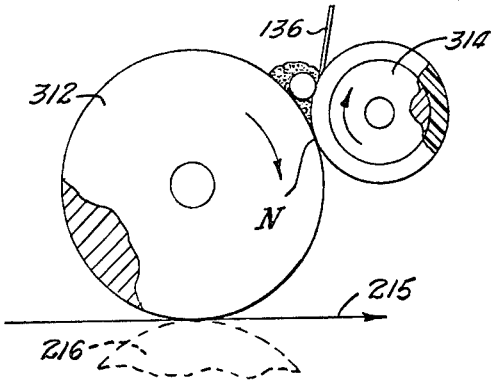

In the embodiment of the invention illustrated in FIG. 15 of the drawing the metering roll 314 has a resilient surface while applicator roll 312 has a hard surface.

Figure 16:
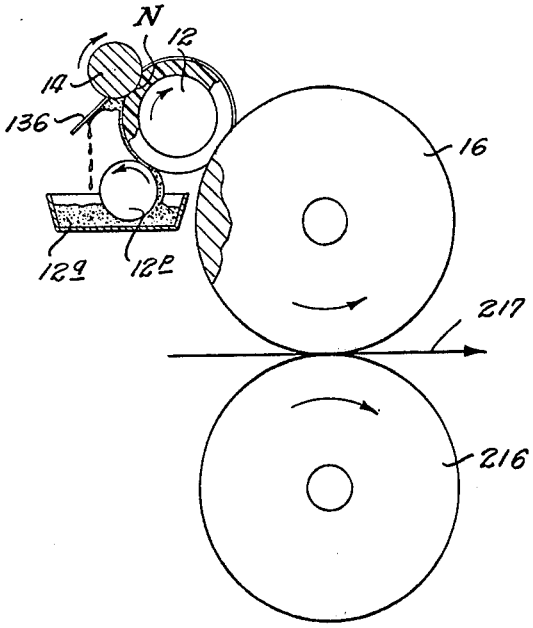
FIG. 16 is a diagramatic view of a modified form of the inker.

In the form of the invention illustrated in FIG. 16 ink is applied to the surface of applicator roller 12 by a pan rollers 12*p* which has a portion of the surface thereof passing through ink in pan 12*q*. The film is metered at the nip N and blade 136 shaves ink from the surface of metering roller 14 allowing the ink to return to the pan 12*q*. Pan roller 12*p* preferably slips relative to the surface of applicator roller 12 to calender an excess quantity of ink onto the surface to eliminate ghosting. The excess ink is then removed by metering roller 14 leaving a smooth uniform layer 13 to be rotated to the surface of cylinder 16. It should be appreciated that the term plate cylinder as used herein is intended to include rollers for applying solid coatings of ink, moisture, plastic, starch and the like to sheets or webs of liquid receptive material or to other rollers.

MODIFIED FORM

A modified form of the metering apparatus is illustrated in FIGS. 19–22 of the drawing.

Applicator roller 12 and metering roller 14, hereinbefore described in the description of the preferred embodiment, are very effective metering devices so long as the viscosity of the ink and the speed of rotation of the rollers is not excessive. However, inks having high viscosity under dynamic conditions have characteristics approaching that of solid material. In the embodiment of the invention illustrated in FIGS. 19–22 of the drawing the metering device 414 is positioned in pressure indented relation with applicator roller 412 substantially as hereinbefore described forming a reservoir containing ink 410 and a metering nip N for applying a layer of ink 413 to applicator roller 412. However, it will be noted that metering device 414 comprises an elongated rigid member having a sharp outwardly extending projection 420 in combination with means for controlling the pressure between the projection 420 and the surface 412*b* applicator roller 412. Metering device 414 is a cutting tool somewhat resembling those and in lathe and shaper work for machining solid materials. The projection 420 is shaped and positioned for cutting or shearing the layer of ink carried on the surface of applicator roller 412. Excessive ink is severed from the ink carried by the applicator roller by a shearing action forcing a change in direction of excess ink in a manner resembling that of chips of material severed from a solid work piece by a lathe cutting tool.

Figure 20:
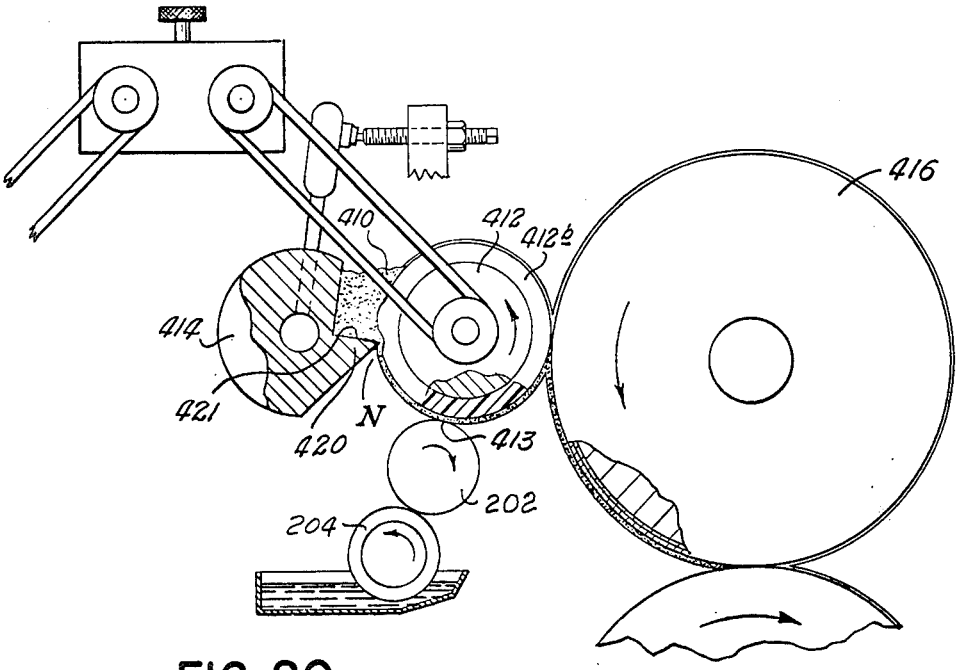

As illustrated in FIG. 20 the upper surface 421 of projection 420 lies in a plane extending substantially radially through the center of metering device 414. However, as viscosity of the ink and the speed of rotation of roller 413 is increased it may be necessary to shape the surfaces as indicated at 421' in FIG. 21 of the drawing to provide additional shearing force.

The angle of inclination of the surface 420 should be selected to provide maximum metering of the ink without imparting excessive wear to the surface of applicator roller 414.

Figure 19:
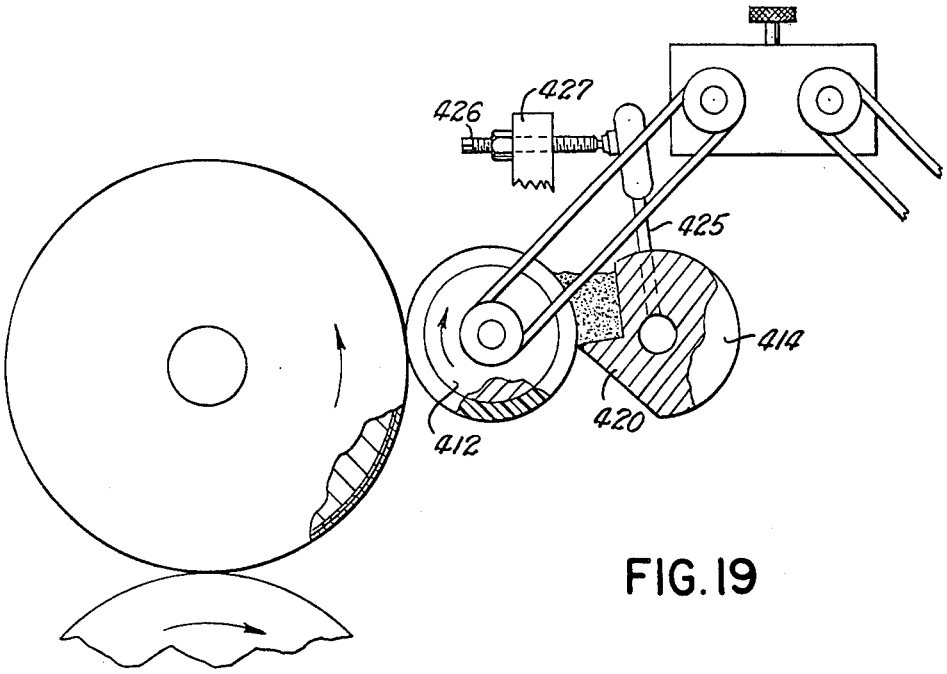
FIGS. 19 and 20 are diagramatic views of a second embodiment of the invention.

As best illustrated in FIGS. 19 and 20 means is provided for controlling the pressure between the edge of projection 420 and the surface of applicator roller 412. In the particular embodiment of the invention illustrated in the drawing metering device 414 has opposite ends rotatably journaled in bearings (not shown) supported by the inker side frames. A link 425 is rigidly secured to metering device 414 for rotation about the center of the bearing in which metering device 414 is mounted. A pressure adjustment screw 426 is threadedly secured in an anchor member 427 secured to the side frame of the press. The end of adjustment screw 426 engages the end of lever 425 such that screw 426 may be rotated for varying pressure between projection 420 and the surface of applicator roller 412. It should be noted that the centers of rotation of applicator roller 412 and metering device 414 are spaced apart a distance less than the combined radius of applicator roller 412 and the distance from the center of metering device 414 to the outer edge of projection 420. Thus, as lever 425 is rotated in a clockwise direction, as viewed in FIG. 19 of the drawing, pressure between projection 420 and the surface of applicator roller 412 is increased.

In the embodiment of the invention illustrated in FIG. 20 a film of ink 413 is metered onto the surface of applicator roller 412 by metering device 414. The rate at which the film 413 is offered to the plate cylinder 416 is dependent upon speed of rotation of applicator roller 412.

Figure 21:
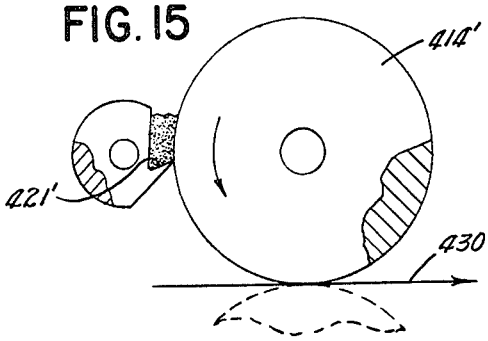
FIGS. 21 and 22 are diagramatic views illustrating use of the second embodiment of the invention for applying coating to liquid receptive material.
Figure 22:
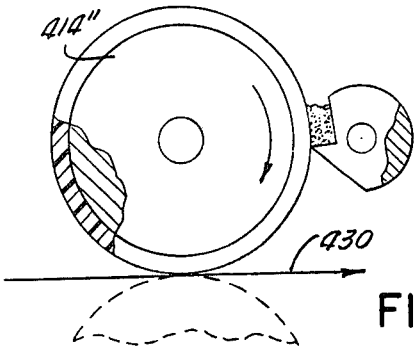

In the forms of the invention illustrated in FIGS. 21 and 22 applicator rollers 414' and 414" are positioned for applying ink directly to a web 430. It should be noted that applicator rollers may be rotated in the same direction or the opposite direction of movement of the web 430. It should also be appreciated that applicator roller 414' has a hard, smooth surface while applicator roller 414' has a smooth resilient surface.

OPERATION

The operation and function of the preferred embodiment device hereinbefore described is as follows:

Pressure regulation between the applicator roller 12 and the plate 15 on plate cylinder 16 is accomplished by rotating threaded members **56*a* and 56*b* relative to the motion limiting stops 48 such that force exerted by throw-off cylinders 40 and 66 urges the applicator roller 12 into pressure engagement with the plate 15 on the plate cylinder 16**.

Pressure between the applicator roller 12 and metering roller 14 is controlled by rotating adjustment screws 96 thereby moving blocks **82*a* and 82*b* longitudinally through slots 84*a* and 84*b*, respectively, in hangers 24 and 26**.

Pressure between the sharp lower edge 142 of doctor blade 136 and the surface of metering roller 14 is controlled by rotating adjustment screws 125 relative to the abutment members 126 on arms 120 which carry doctor blade assembly 114. It should be apparent that as lugs 124 are moved away from abutment members 126 doctor blade holder 116 pivots about pins 118 thereby urging the sharp edge 142 of blade 136 toward the surface of metering roller 14.

To compensate for deflection between applicator roller 12 and metering roller 14, which would result in reduced pressure adjacent central portions of the rollers, skew adjustment screw 72 may be rotated thereby moving an end of the metering roller circumferentially about an end of the applicator roller 12 thereby skewing the rollers for increasing pressure adjacent central portions thereof. It will be noted that since the end of the metering roller 14 is moved circumferentially about the axis of applicator roller 12 pressure may be regulated longitudinally of said rollers without changing pressure adjacent the ends thereof.

Ink is deposited in the reservoir 112, defined between end dams 100 and surfaces of applicator roller 12 and metering roller 14. Referring to FIGS. 17 and 18, the surfaces of applicator roller 12 and metering roller 14 are disposed in pressure indented relation. The pressure between the rollers, controlled by adjusting screws **96*a* and 96*b***, forms a restriction through which ink is delivered.

Pressure between the tip of doctor blade 136 and the surface of metering roll 14 is preferably adjusted to meter a thin continuous, uninterrupted, uniform film **14*t* of ink onto the surface of metering roller 14 which is moving toward the surface of the applicator roller 12. Ink film 14*t* is preferably thinner than film 13 on the surface of applicator roller 12 moving toward the surface of plate 15**.

Thus, by adjusting the pressure and consequently the width of the stripe at the nip N between rollers 12 and 14, and by adjusting the relative surface speeds of rollers 12 and 14, and by controlling the thickness of ink film **14*t* on the surface of metering roller 14; the thickness of the film of ink 13 metered onto the surface of applicator roll 12** can be precisely controlled.

It should be appreciated that the function of ink film **14*t* is to provide a continuous uniform metering surface at the nip N such that conditions can be established and maintained to permit metering of a uniform film 13 onto the surface of applicator roller 12. The film 14*t* further provides lubrication at the nip N reducing power required for rotating metering roller 14** in the manner hereinbefore described and illustrated in the drawing.

The presence of a thin film **14*t* of ink on the surface of metering roll 14 also contributes to precision control of the thickness of the ink film 13 in that the metering apparatus is less sensitive to changes in the speed differential between adjacent surfaces of applicator roller 12 and metering roller 14 than if the surface of the metering roller were wiped completely clean. Consequently, the change in speed ratio of rollers 12 and 14 increases as the thickness of film 14*t* is increased to provide a given change in the thickness of film 13**.

It should further be noted that while nip roller 144 transfers ink from the surface of the metering roller 14 which is moving away from the nip N to the surface of the applicator roller 12 which is moving toward the nip, the roller 144 also functions to work or mill ink thereby applying physical energy or tension to the molecular structure of the ink improving characteristics of ink permitting same to be spread in a smooth uniform film. It should further be apparent that roller 144 breaks up and disperses any air pockets or bubbles in the ink 113 while directing ink toward the nip N.

Figure 11:
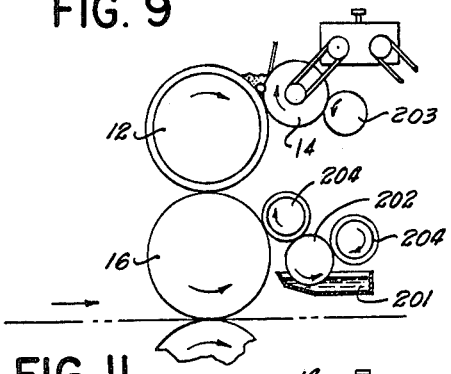
Figure 12:
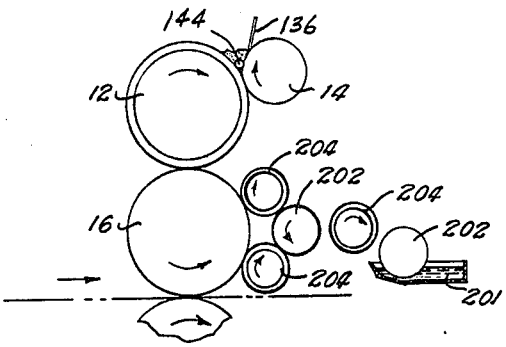
Figure 13:
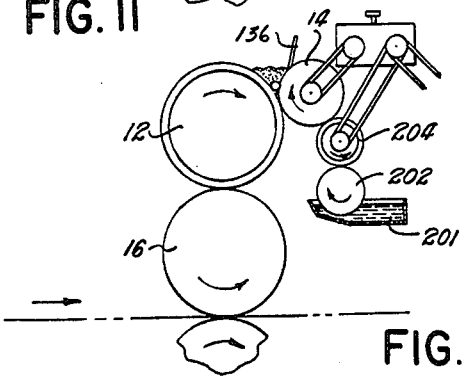

Vibrator roller 203, preferably having a hard surface, oscillates in an axial direction as it rotates in engagement with film 13 to eliminate any streaks which might appear in ink film 13 if the edge of doctor blade 136 has slight irregularities therein or if particles of lint or other foreign material become trapped between the edge of the doctor blade 136 and the surface of roller 14. It should be appreciated that vibrator roller 203 effectively accomplishes the same purpose if positioned as illustrated in FIG. 11 in contact with the surface of film **14*t* on metering roller 14** for smoothing any streaks which might appear on the surface thereof to assure a uniform metering surface at the nip N.

As hereinbefore described metering roller 204' and hydrophilic roller 202' are disposed in pressure indented relation having adjacent surfaces moving in the same direction from metering a film of dampening fluid therebetween, as diagrammatically illustrated in FIG. 17.

Figure 7:
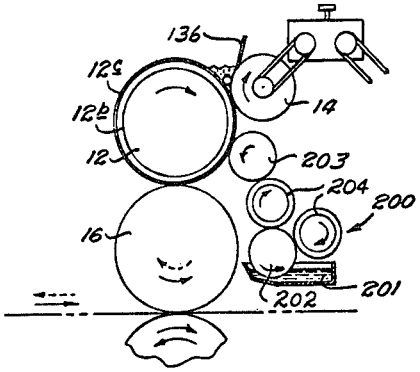
FIGS. 7–13 are diagramatic illustrations of printing presses having the inker in combination with dampening systems for establishing an ink-water balance.

Hydrophilic roller 202' is preferably driven by a variable speed drive means such that the differential speed between the surface thereof and the surface of roller 204 can be precisely controlled thereby controlling the rate of rotation of the metered film of dampening fluid to the surface of roller 204. Roller 204, as illustrated in FIGS. 7 and 8, may be either engaged with the surface of plate 15 or disengaged from the surface thereof.

When roller 204 is disengaged from the surface of plate 15 dampening fluid is applied to the surface of the ink coated vibrator roller 203 and is in turn applied to the surface of ink film 13 on applicator roller 12.

Figure 8:
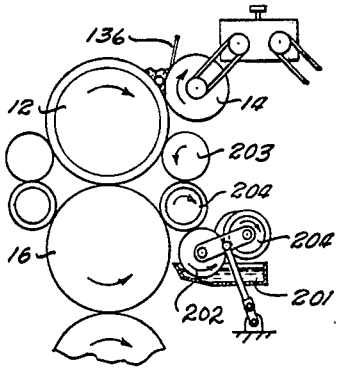
Figure 9:
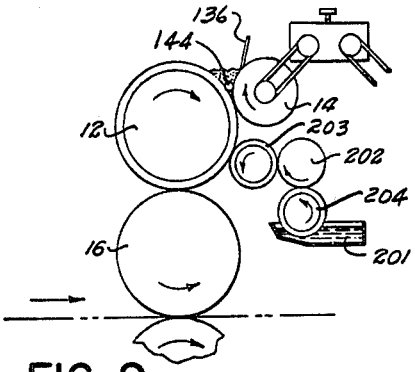

When roller 204 is moved into engagement with plate 15 as illustrated in FIGS. 8 and 17 the film of dampening fluid carried by roller 204 is split, a portion being applied to the surface of the plate. A second portion thereof passing through the nip between rollers 203 and 204 is transferred by roller 203 to the surface of ink film 13 on applicator roller 12.

As the ink film 13 is delivered to the printing plate 15 the ink film 13 will be split depositing a layer of ink **13*a* on image areas of the plate. Some of the ink will remain on the applicator roller 12 in the form of an irregular film 13*b*. Areas of the film 13 which engage non-image areas 15*a* of the plate will remain on the applicator roller with no substantial transfer of ink therefrom. Thus, as viewed in FIG. 17 ink on the surface of applicator roller 12 moving away from contact with the plate 15 will be in a non-uniform distribution. However, as the surface of applicator roller 12 moves through reservoir 112 the irregular ink film will be submerged in ink 113** to completely eliminate the effect commonly referred to as "ghosting".

From the foregoing it should be readily apparent that we have developed ink metering apparatus comprising applicator roller 12 and metering roller 14 arranged in a relationship for forming a uniform film 13 of ink of controlled thickness. The dampening fluid metering apparatus comprising rollers 202' and 204' disposed in pressure indented relation, adjacent surfaces thereof moving in the same direction, meter a uniform film of dampening fluid which is transferred by rollers 204 and 203 into engagement with the film of ink such that a composite layer 13, **13*f* of dampening fluid and ink of controlled proportions is formed. Applicator roller 12 moves the composite layer of dampening fluid and ink into engagement with the surface of lithographic printing plate 15** for depositing dampening fluid on non-image areas and ink on image areas for establishing and maintaining a continuous ink-dampening fluid balance on the plate. The continuous duty ink metering apparatus and the continuous duty dampening fluid metering apparatus accomplishes the objects of the invention hereinbefore discussed and provides a degree of control which has not heretofore been achieved.

It should be readily apparent that other and further embodiments of our invention may be devised without departing from the basic concept of our invention.

Having described my invention I claim:

1. A method for applying a controlled balance of ink and dampening fluid to a lithographic printing plate at a fluid transfer area between the lithographic printing plate and an applicator roller, comprising the steps of (A) forming a continuous uniform ink layer having a desired thickness on the applicator roller for the conveyance into said fluid transfer area and onto said lithographic plate, including the steps of (1) depositing an excess of ink on said applicator roller, (2) providing a metering roller adjacent to said applicator roller, (3) metering the ink deposited on said applicator roller by forming a fluid metering nip between said applicator roller and said metering roller, said applicator roller and said metering roller cooperating to form a reservoir for said excess of ink, (4) supporting said applicator roller and said metering roller in a preselected pressure indented relation to form said nip, (5) rotating said applicator roller and said metering roller such that adjacent surfaces move in opposite directions at said nip and at a preselected speed differential, (6) controlling the thickness of said continuous uniform ink layer formed on said applicator roller by (a) forming a continuous uninterrupted uniform ink layer on the metering roller by placing a doctor blade in cooperation with said metering roller, (b) controlling the physical properties of said layer of ink on said metering roller by controlling temperature of the ink so as to provide a continuous uniform metering surface of ink having uniform physical properties at the said metering nip which upon contact with the ink on said applicator roller will remove all but a uniform layer of ink of a desired thickness from said applicator roller, (c) adjusting said doctor blade for thus adjusting the thickness of said ink layer conveyed by said metering roller into said metering nip in order to create and maintain a desired precision controlled thickness in the said layer of ink conveyed by said applicator roller into the fluid transfer area, (d) adjusting the relative surface speeds of said metering roller and said applicator roller, (e) adjusting the pressure between said metering roller and said applicator roller, (B) applying dampening fluid in a variable amount in accordance with the thickness of the ink layer formed in step (A) to the said layer of ink conveyed by said applicator roller at a point between the fluid metering nip and said fluid transfer area to form a controlled balance of ink and dampening fluid conveyed by said applicator roller into said transfer area without introducing dampening fluid into said metering nip.

2. The method as defined in claim 1, wherein step (A) (6) (b) includes maintaining constant the temperature of the ink being metered by the metering roller.

3. The method as defined in claim 2, wherein the ink temperature is maintained constant by controlling the temperature of the surface of the metering roller.

4. The method as defined in claim 1, wherein step B includes the steps of supplying dampening fluid from a reservoir and preventing the feedback of ink to the reservoir of dampening fluid.

5. The method as defined in claim 1, wherein step B includes forming a uniform continuous layer of dampening fluid by metering the dampening fluid through a pair of rollers pressure biased together to form a dampening fluid nip.

6. The method as defined in claim 5, wherein step B includes the steps of varying the pressure biasing together the rollers of the dampening fluid nip and varying the relative speeds of the surfaces of the rollers forming the dampening fluid nip to control the thickness of the dampening fluid applied to the ink layer conveyed by the applicator roller into the transfer area.

7. A method as defined in claim 1, wherein step (A) (6) (b) includes maintaining the ink within the temperature range of 65° F. to 95° F.

* * * * *